US009130297B2

(12) United States Patent
Xiao et al.

(10) Patent No.: US 9,130,297 B2
(45) Date of Patent: Sep. 8, 2015

(54) USB CONNECTOR AND ELECTRONIC DEVICE

(71) Applicant: Huawei Device Co., Ltd., Shenzhen (CN)

(72) Inventors: Jianjun Xiao, Shenzhen (CN); Menglong Zhao, Shenzhen (CN); Wenqing Fu, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 0 days.

(21) Appl. No.: 14/282,151

(22) Filed: May 20, 2014

(65) Prior Publication Data

US 2014/0256180 A1 Sep. 11, 2014

Related U.S. Application Data

(63) Continuation of application No. PCT/CN2012/084434, filed on Nov. 12, 2012.

(30) Foreign Application Priority Data

Nov. 22, 2011 (CN) ..... 2011 1 0373443

(51) Int. Cl.
*H01R 13/46* (2006.01)
*H01R 13/512* (2006.01)
(Continued)

(52) U.S. Cl.
CPC ..... *H01R 13/46* (2013.01); *H01R 13/512* (2013.01); *H01R 13/648* (2013.01); *H01R 13/6594* (2013.01); *H01R 12/7047* (2013.01)

(58) Field of Classification Search
CPC ..... H01R 13/6595; H01R 13/6594; H01R 13/6658
See application file for complete search history.

(56) References Cited

U.S. PATENT DOCUMENTS 6,685,505 B1 2/2004 Espenshade et al.
7,134,884 B2 * 11/2006 Wang et al. ..... 439/76.1
(Continued)

FOREIGN PATENT DOCUMENTS

CN 2439727 Y 7/2001
CN 2588613 Y 11/2003
(Continued)

OTHER PUBLICATIONS

Partial English Translation and Abstract of Chinese Patent Application No. CN201282211Y, Part 1, Aug. 12, 2014, 2 pages.
(Continued)

*Primary Examiner* — Ross Gushi
(74) *Attorney, Agent, or Firm* — Conley Rose, P.C.; Grant Rodolph; Nicholas K. Beaulieu

(57) ABSTRACT

A universal serial bus (USB) connector and an electronic device including the USB connector are disclosed. The USB connector includes a USB head, a printed circuit board (PCB), and a shell element, where the USB head includes an insulation plastic core and a metal housing; a conductive layer is arranged on the surface of the PCB, the PCB is assembled inside the USB head and the PCB and the USB head are mutually positioned; and the USB head and the PCB are fastened at the shell element by using a fastening member, and the metal housing is pressure-welded on the conductive layer on the surface of the PCB. The USB connector has improved structural strength and enhanced grounding reliability, and can also achieve product miniaturization and cost reduction.

14 Claims, 6 Drawing Sheets

(51) Int. Cl.

| | |
|---|---|
| ***H01R 13/6594*** | (2011.01) |
| ***H01R 13/648*** | (2006.01) |
| *H01R 12/70* | (2011.01) |

(56) References Cited

U.S. PATENT DOCUMENTS

| | | | | |
|---|---|---|---|---|
| 7,172,460 | B2 * | 2/2007 | Zhao et al. | 439/607.56 |
| 7,335,036 | B1 | 2/2008 | Lin | |
| 7,359,208 | B2 * | 4/2008 | Ni | 361/752 |
| 7,407,390 | B1 * | 8/2008 | Ni | 439/76.1 |
| 7,442,051 | B2 * | 10/2008 | Jiang et al. | 439/76.1 |
| 7,524,198 | B2 * | 4/2009 | Nguyen et al. | 439/131 |
| 7,540,786 | B1 * | 6/2009 | Koser et al. | 439/660 |
| 7,748,995 | B1 * | 7/2010 | Lee | 439/76.1 |
| 7,766,672 | B1 * | 8/2010 | Chiang | 439/76.1 |
| 7,771,215 | B1 * | 8/2010 | Ni et al. | 439/131 |
| 7,798,853 | B2 * | 9/2010 | Shi et al. | 439/607.58 |
| 7,802,997 | B2 * | 9/2010 | Kuo | 439/76.1 |
| 7,824,227 | B1 * | 11/2010 | Lee et al. | 439/660 |
| 7,833,056 | B1 * | 11/2010 | Lee et al. | 439/607.23 |
| 7,850,468 | B2 * | 12/2010 | Ni et al. | 439/131 |
| 7,909,654 | B2 * | 3/2011 | He et al. | 439/660 |
| 7,914,299 | B2 * | 3/2011 | Lee | 439/76.1 |
| 7,927,145 | B1 * | 4/2011 | Chang | 439/607.31 |
| 7,946,857 | B2 * | 5/2011 | Wang | 439/76.1 |
| 7,988,495 | B2 * | 8/2011 | Chung | 439/660 |
| 8,089,751 | B2 * | 1/2012 | Lo | 361/679.31 |
| 8,116,083 | B2 * | 2/2012 | Ni et al. | 361/737 |
| 8,120,903 | B2 * | 2/2012 | Lin et al. | 361/679.4 |
| 8,206,161 | B1 * | 6/2012 | Lan et al. | 439/76.1 |
| 8,215,981 | B2 * | 7/2012 | Liu et al. | 439/487 |
| 8,292,671 | B2 * | 10/2012 | Chung | 439/660 |
| 8,360,809 | B2 * | 1/2013 | Chou et al. | 439/620.21 |
| 8,366,490 | B2 * | 2/2013 | Wu | 439/660 |
| 8,366,491 | B2 * | 2/2013 | Wu | 439/660 |
| 8,480,435 | B2 * | 7/2013 | Hsiao et al. | 439/660 |
| 8,480,436 | B2 * | 7/2013 | Chang | 439/660 |
| 8,523,610 | B2 * | 9/2013 | Kuster | 439/607.01 |
| 8,545,273 | B1 * | 10/2013 | Chen | 439/660 |
| 8,602,822 | B2 * | 12/2013 | Siahaan et al. | 439/607.41 |
| 8,602,825 | B2 * | 12/2013 | Chen | 439/660 |
| 8,602,826 | B2 * | 12/2013 | Zhang | 439/660 |
| 8,625,270 | B2 * | 1/2014 | Ni et al. | 361/679.31 |
| 8,662,929 | B2 * | 3/2014 | Chou et al. | 439/620.21 |
| 8,721,370 | B2 * | 5/2014 | Liu et al. | 439/660 |
| 8,734,182 | B2 * | 5/2014 | Peng et al. | 439/607.01 |
| 8,794,981 | B1 * | 8/2014 | Rodriguez et al. | 439/76.1 |
| 8,979,594 | B2 * | 3/2015 | Tsai | 439/660 |
| 8,998,647 | B2 * | 4/2015 | Tsai et al. | 439/660 |
| 2006/0148332 | A1 * | 7/2006 | Wang et al. | 439/761 |
| 2009/0093136 | A1 | 4/2009 | Hiew et al. | |
| 2009/0117784 | A1 * | 5/2009 | Wu | 439/660 |
| 2009/0190277 | A1 | 7/2009 | Hiew et al. | |
| 2010/0075544 | A1 | 3/2010 | Liu et al. | |
| 2011/0003502 | A1 | 1/2011 | Li et al. | |
| 2011/0021043 | A1 | 1/2011 | Lee | |
| 2011/0136352 | A1 * | 6/2011 | Liu et al. | 439/76.1 |
| 2011/0244733 | A1 * | 10/2011 | Ueda et al. | 439/660 |
| 2012/0052731 | A1 * | 3/2012 | Hsiao et al. | 439/620.22 |
| 2012/0289089 | A1 * | 11/2012 | Tsai et al. | 439/620.22 |
| 2014/0220796 | A1 * | 8/2014 | Chang | 439/64 |
| 2014/0256164 | A1 * | 9/2014 | Lin | 439/76.1 |
| 2014/0256180 | A1 * | 9/2014 | Xiao et al. | 439/607.22 |

FOREIGN PATENT DOCUMENTS

| | | | |
|---|---|---|---|
| CN | 201018139 | Y | 2/2008 |
| CN | 2011091683 | Y | 2/2009 |
| CN | 2012082211 | Y | 7/2009 |
| CN | 2012085936 | Y | 8/2009 |
| CN | 201440485 | U | 4/2010 |
| CN | 201956545 | U | 8/2011 |
| CN | 201985296 | U | 9/2011 |
| CN | 102496804 | A | 6/2012 |

OTHER PUBLICATIONS

Partial English Translation and Abstract of Chinese Patent Application No. CN201282211Y, Part 2, Jun. 20, 2014, 3 pages.

Partial English Translation and Abstract of Chinese Patent Application No. CN2439727Y, Part 1, Aug. 12, 2014, 2 pages.

Partial English Translation and Abstract of Chinese Patent Application No. CN2439727Y, Part 2, Aug. 12, 2014, 3 pages.

Partial English Translation and Abstract of Chinese Patent Application No. CN201191683Y, Part 1, Aug. 12, 2014, 2 pages.

Partial English Translation and Abstract of Chinese Patent Application No. CN201191683Y, Part 2, Aug. 12, 2014, 4 pages.

Foreign Communication From a Counterpart Application, Chinese Application No. 201110373443.1, Chinese Office Action dated Mar. 5, 2013, 6 pages.

Foreign Communication From a Counterpart Application, PCT Application No. PCT/CN2012/084434, English Translation of International Search Report dated Feb. 21, 2013, 3 pages.

Foreign Communication From a Counterpart Application, PCT Application No. PCT/CN2012/084434, English Translation of Written Opinion dated Feb. 21, 2013, 7 pages.

Partial English Translation and Abstract of Chinese Patent Application No. CN201985296U, Part 1, Nov. 5, 2014, 14 pages.

Partial English Translation and Abstract of Chinese Patent Application No. CN201985296U, Part 2, Nov. 5, 2014, 4 pages.

Foreign Communication From a Counterpart Application, European Application No. 12851385.0, Extended European Search Report dated Oct. 6, 2014, 7 pages.

* cited by examiner

USB CONNECTOR AND ELECTRONIC DEVICE

CROSS-REFERENCE TO RELATED APPLICATIONS

This application is a continuation of International Application No. PCT/CN2012/084434, filed on Nov. 12, 2012, which claims priority to Chinese Patent Application No. 201110373443.1, filed on Nov. 22, 2011, both of which are hereby incorporated by reference in their entireties.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to the field of electrical connector technologies, and in particular, to a Universal Serial Bus (USB) connector and an electronic device including the USB connector.

BACKGROUND

A USB connector is widely applied in electronic devices, such as data cards, and USB flash drives (e.g., a U drive), and these data cards and USB flash drives are commonly applied in electronic products such as a mobile phone, a walkie talkie, a telephone, and a computer. The data cards and USB flash drives are frequently inserted and removed in use; therefore, there are high requirements for the structural strength and grounding reliability of the USB connector.

Currently, a USB connector generally has six pins, four of which are function pins used to transmit a signal or data, and the other two are grounding pins used to ground a shell element of the USB connector and further improve welding strength of the USB connector. In the process of inserting and removing the USB connector, welding joints of the two grounding pins become major force-bearing points for insertion and removal stresses. It can be learned from failure analysis of USB connectors that in most failure samples a crack occurs at a welding joint of a grounding pin because grounding pins are major force-bearing points. If a problem occurs at a welding joint of a grounding pin, on one hand, grounding reliability of the USB connector is affected, and on the other hand, structural strength of the USB connector is also affected, resulting in a failure or malfunction of the USB connector. Especially, during use by a user, in a case in which incautious use occurs, such as incorrect insertion, falling down, or bump, a welding joint loosens more easily, impairing reliability of the USB connector. Therefore, under the premise that the grounding reliability of the USB connector is ensured, it is crucial to ensure structural strength reliability of the USB connector.

In addition, a main structure forming a current USB connector, namely, a USB head, is generally connected to a printed circuit board (PCB) of the USB connector by means of welding or by using an additional mechanical structure, for example, a fixed lug, so as to implement positioning of the USB head and the PCB. However, in a case in which positioning is implemented by means of welding, because of a reliability problem of welding techniques, mutual positioning between the USB head and the PCB may become unreliable, thereby affecting structural strength of the USB connector, resulting in a failure or malfunction of the USB connector. In a case in which positioning is implemented by using an additional mechanical structure, for example, a fixed lug, structural complexity is obviously increased, and thereby costs are undesirably increased. Especially, during use by a user, in a case in which incautious use occurs, such as incorrect insertion, falling down, or bump, mutual positioning between the USB head and the PCB may easily become unreliable, impairing reliability of the USB connector.

FIG. 1 schematically shows a USB connector in prior art 1. A terminal of a male connector of a USB head is connected to a female connector to achieve the purpose of working. The male connector of the USB head is welded on a PCB by using four weld legs on the USB head, which not only achieves the effect of grounding, but also achieves the effect of mutual positioning between the USB head and the PCB. However, for the USB connector in prior art 1, the USB head is welded on the PCB to implement grounding and positioning between the USB head and the PCB; however, because of a reliability problem of welding techniques, for example, faulty welding, the USB connector has undesirable structural strength and grounding reliability. In addition, the USB head is welded on the PCB; therefore, the overall thickness of the USB connector is relatively large, which adversely affects product miniaturization and cost reduction of the USB connector. Moreover, the USB head of the USB connector in prior art 1 is welded on the PCB by using the four weld legs on the USB head, and the four weld legs increase the overall length of the USB head. As a result, the total length of the USB head reaches 21.5 millimeters (mm). During use by a user, an excessively long USB head more easily causes improper use, for example, incorrect insertion. Besides, the USB head is relatively long, and therefore the overall rigidity of the USB head is relatively low, making it easy to bend and deform during use, thereby resulting in a failure or malfunction of the USB connector. In addition, compared with a current USB connector that usually has two grounding pins, the USB head of the USB connector in prior art 1 has four weld legs, and therefore, two weld legs are added. As a result, the excessive long USB head and the two added weld legs both adversely affect product miniaturization and cost reduction of the USB connector.

FIG. 2A and FIG. 2B schematically show a USB connector in prior art 2. An edge connector, referred to as a golden finger, of a PCB is connected to a female connector of a USB head, so as to achieve the purpose of working. A lug is additionally arranged on a metal housing of the USB head, and the lug is fastened at a shell element of the USB connector by using a screw to achieve the purpose of grounding the shell element of the USB connector. However, for the USB connector in prior art 2, grounding is implemented by fastening the lug of the USB head to the shell element of the USB connector, thereby causing the problem of complex structure and unreliable grounding. Moreover, there is no positioning between the USB head and the PCB; therefore, structural strength of the USB connector is undesirable. In addition, for the USB connector in prior art 2, the USB head is connected to the shell element of the connector by using the lug additionally arranged on the metal housing of the USB head, and therefore the additionally arranged lug increases the overall length of the USB head, and the total length of the USB head reaches 18 mm. During use by a user, an excessively long USB head more easily causes improper use, for example, incorrect insertion. Besides, the USB head is relatively long, and therefore the overall rigidity of the USB head is relatively low, making it easy to bend and deform during use, thereby resulting in a failure or malfunction of the USB connector. The excessive long USB head also adversely affects product miniaturization and cost reduction of the USB connector.

With the saturation in the market of data cards and USB flash drives and intensifying competition among manufacturers, the industry urgently needs a USB connector that has improved structural strength and enhanced grounding reliability and can achieve the objectives of product miniaturization and cost reduction.

SUMMARY

In view of the prior art, the present invention is provided. The present invention may be used to solve the problem of undesirable structural strength and poor grounding reliability of a USB connector in the prior art. In view of this, embodiments of the present invention provide a USB connector. The USB connector improves structural strength and grounding reliability, and may further shorten the length of a USB head, thereby achieving the objectives of product miniaturization and cost reduction.

According to the present invention, a USB connector includes a USB head, a PCB and a shell element, where the USB head includes an insulation plastic core and a metal housing; a conductive layer is arranged on the surface of the PCB, the PCB is assembled inside the USB head and the PCB and the USB head are mutually positioned; and the USB head and the PCB are fastened at the shell element by using a fastening member, and the metal housing is pressure-welded on the conductive layer on the surface of the PCB.

Preferably or additionally, a first slot and a second slot are arranged on the PCB, a first buckle and a second buckle are arranged on the insulation plastic core of the USB head, and the first buckle and the second buckle are buckled inside the first slot and the second slot, respectively.

Preferably or additionally, the first buckle and the second buckle are elastic elements.

Preferably or additionally, the first buckle and the second buckle are asymmetrically arranged on the insulation plastic core.

Preferably or additionally, the fastening member is a screw.

Preferably or additionally, holes for inserting the screw are formed on the metal housing of the USB head and the PCB, respectively, a mounting column, for screwing and keeping the screw, is arranged on the shell element, and the mounting column protrudes from the bottom of the shell element and a threaded hole is formed inside the mounting column.

Preferably or additionally, the conductive layer is a copper layer.

Preferably or additionally, a plurality of conductive terminals is arranged on the insulation plastic core of the USB head, and the plurality of conductive terminals is electrically connected to an edge connector of the PCB.

For a USB connector according to the present invention, a PCB and a USB head are mutually positioned by using a buckle-slot structure, and are fastened at a shell element by using a fastening member; therefore, overall structural strength of the USB connector is ensured. Also, a metal housing of the USB head is pressure-welded on a conductive layer on the surface of the PCB; therefore, grounding reliability of the shell element of the USB connector is ensured.

In addition, for the USB connector according to the present invention, the PCB and the USB head are mutually positioned by using the buckle-slot structure, and are fastened at the shell element by using the fastening member; therefore, compared with the prior art, welding joints used to connect the USB head and the PCB are eliminated, and a lug used to fasten the USB head to the shell element of the USB connector does not need to be additionally arranged on the USB head. Therefore, by using the USB connector according to the present invention, the length of the USB head can be shortened, thereby achieving product miniaturization and production cost reduction.

Moreover, for the USB connector according to the present invention, the first buckle and the second buckle are formed asymmetrically, a fool-proof function is ensured in the process of assembling the PCB inside the USB head, inverse or incorrect insertion of the PCB is avoided, thereby ensuring the function of normal use of the USB connector.

In addition, the present invention further provides an electronic device including the USB connector.

According to the present invention, the electronic device may be a data card or a USB flash drive, and definitely may also be other electronic products such as a mobile phone, a walkie talkie, a telephone, a computer, and a peripheral of the computer.

BRIEF DESCRIPTION OF THE DRAWINGS

To describe the technical solutions in the embodiments of the present invention or in the prior art more clearly, the following briefly introduces the accompanying drawings required for describing the embodiments. The accompanying drawings in the following description show merely some embodiments of the present invention, and a person of ordinary skill in the art may still derive other drawings from these accompanying drawings without creative efforts. In the accompanying drawings.

DETAILED DESCRIPTION

The present invention is clearly described in the following with reference to the accompanying drawings and by using specific embodiments. The embodiments described are merely a part rather than all of the embodiments of the present invention. A person skilled in the art can know other characteristics and effects of the present invention through the content disclosed by the present invention.

Figure 1:
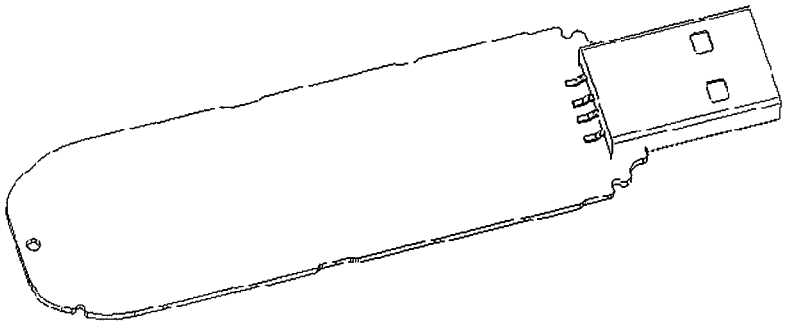
FIG. 1 (PRIOR ART)
FIG. 1 schematically shows a USB connector in prior art 1.
Figure 2A:
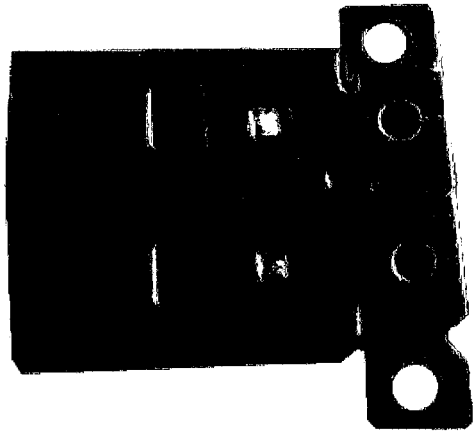
FIG. 2A (PRIOR ART)
FIG. 2A and FIG. 2B schematically show a USB connector in prior art 2.
Figure 2B:
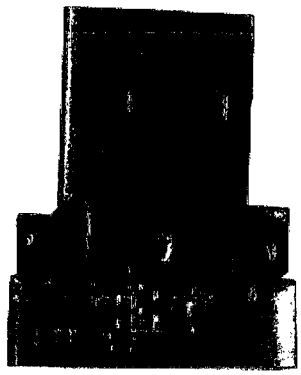
FIG. 2B (PRIOR ART)
Figure 3:
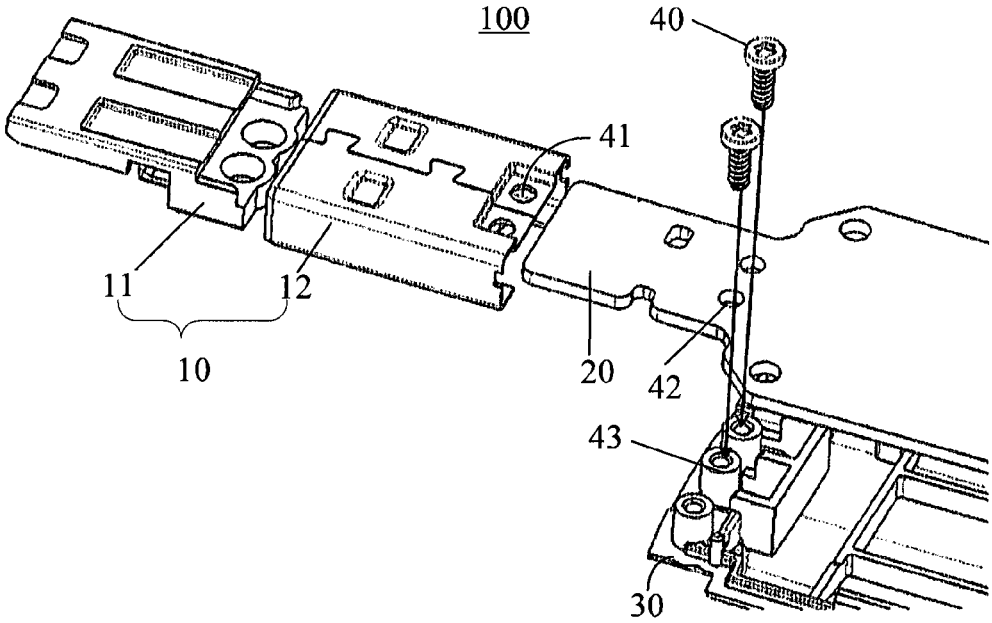
FIG. 3 is a schematic three-dimensional (3D) exploded view of a USB connector according to the present invention.

An embodiment of the present invention provides a USB connector. As shown in FIG. 3, a USB connector 100 according to the present invention includes a USB head 10, a PCB 20, and a shell element 30. A fastening member, for example, a screw 40, is used to fasten the PCB 20 on the shell element 30, which will be described in detail in the following.

Figure 4:
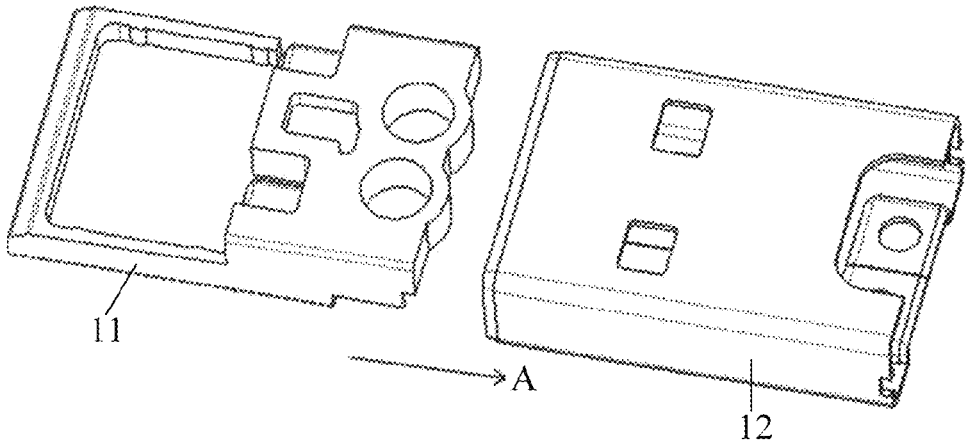
FIG. 4 is a schematic diagram of components of a USB head of the USB connector shown in FIG. 3 and assembly of the components.

As shown in FIG. 4, the USB head 10 is formed by an insulation plastic core 11 and a metal housing 12. The insulation plastic core 11 is assembled inside the metal housing 12 in the direction of arrow A shown in FIG. 4 and is covered by the metal housing 12, so that the insulation plastic core 11 and the metal housing 12 are assembled to form the USB head 10. It can be noted that for clarity, FIG. 4 shows the reverse side of the insulation plastic core 11 and the metal housing 12 shown in FIG. 3.

As is well known by a person skilled in the art, a plurality of conductive terminals (not shown) may be pre-arranged on the insulation plastic core 11, and the conductive terminals form signal or data transmission pins of the USB connector.

Figure 5A:
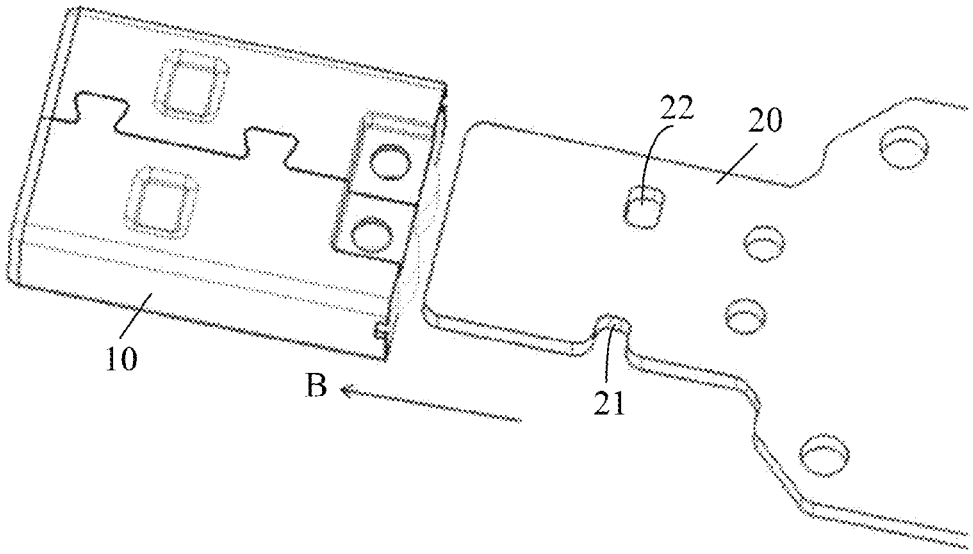
FIG. 5A is a schematic view of assembly of the assembled USB head shown in FIG. 4 and a PCB.
Figure 5B:
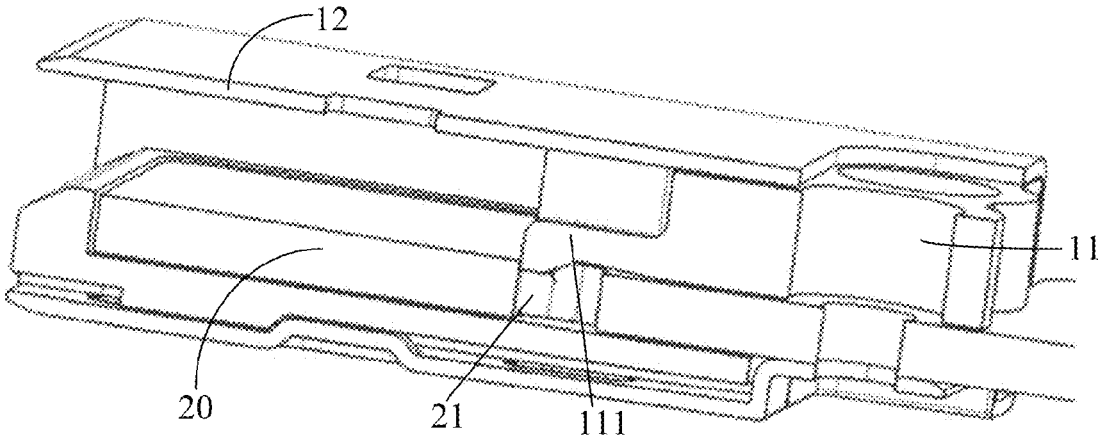
FIG. 5B is a schematic 3D sectional view of the assembled USB head and PCB shown in FIG. 5A.
Figure 5C:
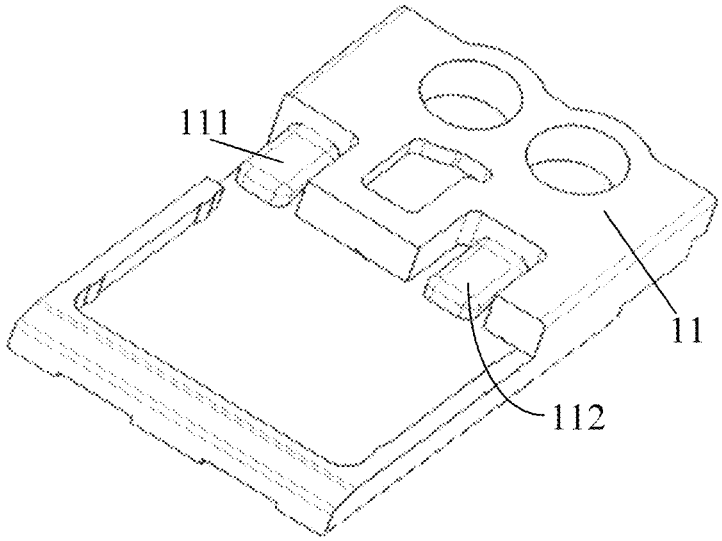
FIG. 5C schematically shows an insulation plastic core, which is a component of a USB head of a USB connector according to the present invention.

As shown in FIG. 5A to FIG. 5C, the PCB 20 is assembled inside the USB head 10 in the direction of arrow B shown in FIG. 5A, so that a golden finger, namely, an edge connector, of the PCB 20 is connected to the conductive terminals, namely, the signal or data transmission pins, on the insulation plastic core 11, so as to achieve the purpose of signal conduction.

A first slot 21 and a second slot 22 are arranged on the PCB 20. Accordingly, a first buckle 111 and a second buckle 112 are arranged on the insulation plastic core 11. The first buckle 111 and the second buckle 112 are elastic, or the first buckle 111 and the second buckle 112 are formed by elastic elements. For example, the first buckle 111 and the second buckle 112 are rubber protrusions formed on the insulation plastic core 11. In a process of inserting the PCB 20 into the USB head 10, the first buckle 111 and the second buckle 112 are buckled inside the corresponding first slot 21 and second slot 22, respectively. In this way, the PCB 20 and the insulation plastic core 11 can be reliably and mutually positioned, and therefore the PCB 20 and the USB head 10 can be reliably and mutually positioned.

To simplify a production process, the first buckle 111 and the second buckle 112 may be symmetrically formed on the insulation plastic core 11. However, preferably, as shown in detail in FIG. 5C, the first buckle 111 and the second buckle 112 are asymmetrically formed on the insulation plastic core 11. This design ensures a fool-proof function in a process of assembling the PCB 20 inside the USB head 10, that is, the asymmetrically arranged first buckle 111 and second buckle 112 prevent a USB connector manufacturer from inversely or incorrectly inserting the PCB 20 in the process of assembling the PCB 20 inside the USB head 10, thereby ensuring the function of normal use of the USB connector.

Figure 6A:
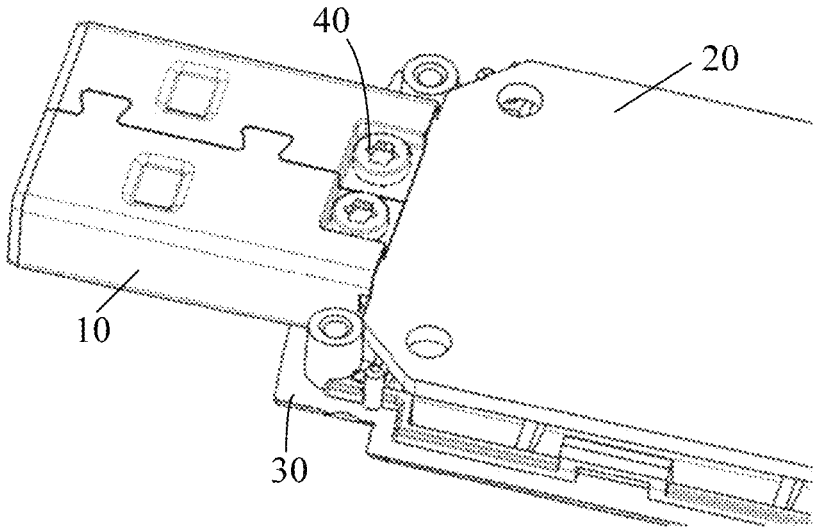
FIG. 6A is a schematic view of assembly of the assembled USB head and PCB shown in FIG. 5A, and a shell element.
Figure 6B:
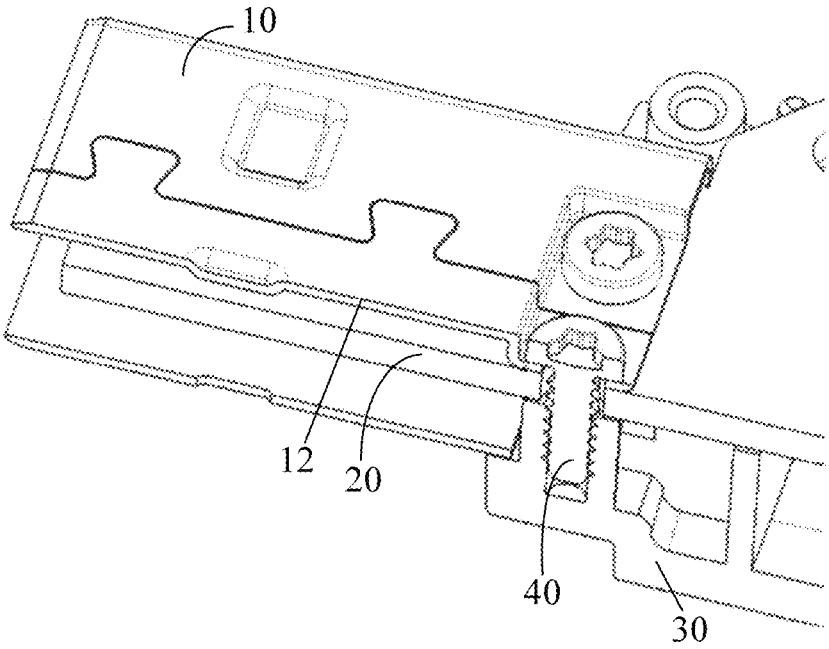
FIG. 6B is a schematic 3D sectional view of the assembled USB head, PCB, and shell element shown in FIG. 6A.

As shown in FIG. 6A and FIG. 6B, after the USB head 10 and the PCB 20 are assembled in the foregoing manner, the buckled USB head 10 and PCB 20 are fastened to the shell element 30 by using the fastening member. The fastening member may be, for example, the screw 40. Therefore, a hole 41 and a hole 42 for inserting the screw 40 (refer to FIG. 3) are formed in advance on the metal housing 12 of the USB head 10 and the PCB 20, respectively. Accordingly, a mounting column 43, for screwing and keeping the screw 40 (refer to FIG. 3), is arranged on the shell element 30. The mounting column 43 protrudes from the bottom of the shell element 30 and a threaded hole is formed inside the mounting column 43. In the foregoing manner, the buckled USB head 10 and PCB 20 are fastened to the shell element 30, thereby ensuring overall structural strength of the USB connector 100.

Further, a conductive layer is arranged on the surface of the PCB 20, the arrangement of the conductive layer may be, for example, implemented by using a plurality of known methods such as electroplating, coating, and chemical deposition, and the conductive layer may be, for example, a copper layer. After the buckled USB head 10 and the PCB 20 are fastened to the shell element 30 by using the screw 40, as shown in FIG. 6B, the metal housing 12 of the USB head 10 is pressure-welded on the conductive layer on the surface of the PCB 20 by using the screw 40, thereby implementing a grounding function of the metal housing 12, and further the whole shell element 30 of the USB connector 100.

For a USB connector according to the present invention, a PCB and a USB head are mutually positioned by using a buckle-slot structure and the buckled USB head and PCB are fastened to a shell element by using a screw; therefore, overall structural strength of the USB connector is ensured.

Besides, for the USB connector according to the present invention, after the buckled USB head and PCB are fastened to the shell element by using the screw, the metal housing of the USB head is pressure-welded on the conductive layer on the surface of the PCB by using the screw; therefore, compared with the prior art, in which the grounding function is implemented by welding grounding pins, grounding reliability of the shell element of the USB connector is ensured.

In addition, for the USB connector according to the present invention, the PCB and the USB head are mutually positioned by using the buckle-slot structure, and are fastened to a shell element by using a fastening member; therefore, compared with the prior art, welding joints used to connect the USB head and the PCB are eliminated, and a lug used to fasten the USB head on the shell element of the USB connector does not need to be additionally arranged on the USB head. As a result, by using the USB connector according to the present invention, the length of the USB head can be shortened, thereby achieving product miniaturization and production cost reduction.

In addition, for the USB connector according to the present invention, a plurality of buckles, is asymmetrically formed, of the buckle-slot structure used to implement accurate and reliable positioning of the PCB and the USB head; therefore, a fool-proof function in the process of assembling the PCB inside the USB head is ensured, and inverse or incorrect insertion of the PCB is avoided, thereby ensuring the function of normal use of the USB connector.

A person skilled in the prior may understand that the USB connector according to the present invention is not only applicable to a data card and a USB flash drive, but also applicable to other portable electronic products such as a mobile phone, a walkie talkie, a telephone, a computer, and a peripheral of the computer.

The embodiments described in the foregoing are merely exemplary. A person skilled in the art may make various modifications and variations to the foregoing embodiments without departing from the scope and essence of the present invention. Therefore, it should be understood that the protection scope of the present invention shall be subject to the protection scope of the claims.

What is claimed is:

1. A universal serial bus (USB) connector, comprising:

a USB head;

a printed circuit board (PCB); and a shell element, wherein the USB head comprises an insulation plastic core and a metal housing, wherein a conductive layer is arranged on the surface of the PCB, the PCB is assembled inside the USB head, and the PCB and the USB head are mutually positioned, and wherein the USB head and the PCB are fastened at the shell element by using a fastening member, and the metal housing is pressure-welded on the conductive layer on the surface of the PCB.

2. The USB connector according to claim 1, wherein a first slot and a second slot are arranged on the PCB, wherein a first buckle and a second buckle are arranged on the insulation plastic core of the USB head, and wherein the first buckle and the second buckle are buckled inside the first slot and the second slot, respectively.

3. The USB connector according to claim 2, wherein the first buckle and the second buckle are elastic elements.

4. The USB connector according to claim 3, wherein the first buckle and the second buckle are asymmetrically arranged on the insulation plastic core.

5. The USB connector according to claim 1, wherein the fastening member is a screw.

6. The USB connector according to claim 5, wherein holes for inserting the screw are formed on the metal housing of the USB head and the PCB, respectively, wherein a mounting column for screwing and keeping the screw is arranged on the shell element, and wherein the mounting column protrudes from the bottom of the shell element and a threaded hole is formed inside the mounting column.

7. The USB connector according to claim 1, wherein the conductive layer is a copper layer.

8. The USB connector according to claim 1, wherein a plurality of conductive terminals is arranged on the insulation plastic core of the USB head, and wherein the plurality of conductive terminals is electrically connected to an edge connector of the PCB.

9. An electronic device, comprising:

a universal serial bus (USB) connector, wherein the USB connector comprises a USB head, a printed circuit board (PCB), and a shell element, wherein the USB head comprises an insulation plastic core and a metal housing, wherein a conductive layer is arranged on the surface of the PCB, the PCB is assembled inside the USB head, and the PCB and the USB head are mutually positioned, and wherein the USB head and the PCB are fastened at the shell element by using a fastening member, and the metal housing is pressure-welded on the conductive layer on the surface of the PCB.

10. The electronic device according to claim 1, wherein a first slot and a second slot are arranged on the PCB, wherein a first buckle and a second buckle are arranged on the insulation plastic core of the USB head, wherein the first buckle and the second buckle are buckled inside the first slot and the second slot, respectively, and wherein the first buckle and the second buckle are elastic elements.

11. The electronic device according to claim 10, wherein the first buckle and the second buckle are asymmetrically arranged on the insulation plastic core.

12. The electronic device according to claim 9, wherein the fastening member is a screw.

13. The electronic device according to claim 12, wherein holes for inserting the screw are formed on the metal housing of the USB head and the PCB, respectively, wherein a mounting column for screwing and keeping the screw is arranged on the shell element, and wherein the mounting column protrudes from the bottom of the shell element, and a threaded hole is formed inside the mounting column (43).

14. The electronic device according to claim 9, wherein a plurality of conductive terminals is arranged on the insulation plastic core of the USB head, and wherein the plurality of conductive terminals is electrically connected to an edge connector of the PCB.

* * * * *

UNITED STATES PATENT AND TRADEMARK OFFICE

CERTIFICATE OF CORRECTION

PATENT NO. : 9,130,297 B2
APPLICATION NO. : 14/282151
DATED : September 8, 2015
INVENTOR(S) : Jianjun Xiao, Menglong Zhao and Wenqing Fu It is certified that error appears in the above-identified patent and that said Letters Patent is hereby corrected as shown below:

Title Page, Item (30) Foreign Application Priority Data section should read:

Nov. 22, 2011 (CN) ..... 201110373443.1

Signed and Sealed this
Twenty-ninth Day of March, 2016

Michelle K. Lee

Michelle K. Lee
*Director of the United States Patent and Trademark Office*